US006477336B2

(12) United States Patent
Hibi

(10) Patent No.: US 6,477,336 B2
(45) Date of Patent: Nov. 5, 2002

(54) PROCESS CARTRIDGE AND IMAGE FORMING APPARATUS HAVING A DEVELOPER AMOUNT DETECTING MEMBER

(75) Inventor: Takashi Hibi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/780,419

(22) Filed: Feb. 12, 2001

(65) Prior Publication Data

US 2001/0021314 A1 Sep. 13, 2001

(30) Foreign Application Priority Data

Feb. 15, 2000 (JP) ..... 2000-037165
Feb. 1, 2001 (JP) ..... 2001-025720

(51) Int. Cl.[7] ..... G03G 15/08
(52) U.S. Cl. ..... 399/27; 399/30
(58) Field of Search ..... 399/24, 25, 27, 399/29, 30, 58, 61, 111, 258; 324/658, 660, 663, 686, 676

(56) References Cited

U.S. PATENT DOCUMENTS 5,095,335 A 3/1992 Watanabe et al. ..... 399/111
5,126,800 A 6/1992 Shishido et al. ..... 399/111
5,214,475 A * 5/1993 Ishii et al. ..... 399/27
5,722,002 A * 2/1998 Kikuta et al. ..... 399/30
5,802,419 A * 9/1998 Sakurai et al. ..... 399/26
5,835,818 A 11/1998 Hoshika et al. ..... 399/26
5,943,525 A * 8/1999 Endo et al. ..... 399/27
6,142,016 A * 11/2000 Kobayashi et al. ..... 399/27 X

FOREIGN PATENT DOCUMENTS

JP 5-100571 4/1993

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

A process cartridge detachably mountable to a main assembly of an electrophotographic image forming apparatus, includes a cartridge frame; an electrophotographic photosensitive member; a developer accommodating portion for accommodating a developer; a developing member for developing an electrostatic latent image formed on the electrophotographic photosensitive member with the developer; a developer feeding member for feeding the developer accommodated in the developer accommodating portion toward the developing member; and a developer amount detecting member, disposed along a movement path of the developer from the developer accommodating portion toward the developing member, for generating an electric signal for permitting the main assembly to detect substantially real time a remaining amount of the developer in the process cartridge, wherein the developer amount detecting member is disposed at and along an arcuate portion which is provided outside the cartridge frame along a path of rotational motion of the developer feeding member.

19 Claims, 6 Drawing Sheets

PROCESS CARTRIDGE AND IMAGE FORMING APPARATUS HAVING A DEVELOPER AMOUNT DETECTING MEMBER

FIELD OF THE INVENTION AND RELATED ART

The present invention relates to an electrophotographic image forming apparatus, and a process cartridge.

Here, an electrophotographic image forming apparatus includes, for example, an electrophoto-graphic copying machine, an electrophotographic printer (for example, LED printer, laser beam printer, and the like), an electrophotographic facsimile apparatus, an electrophotographic word processor, and the like.

A process cartridge means a cartridge in which a charging means, a minimum of one processing means, either a developing means and a cleaning means, and an electrophotographic photosensitive member, are integrally placed, and which is removably mountable in the main assembly of an electrophotographic image forming apparatus; or a cartridge in which a minimum of a developing means, and an electrophotographic photosensitive member, are integrally placed, and which is removably mountable in the main assembly of an image forming apparatus.

Conventionally, an image forming apparatus which employs an electrophotographic image formation process also employs a process cartridge system. According to a process cartridge system, an electrophotographic photosensitive member, and a single or plural processing means, which act on an electrophotographic photosensitive member, are integrally placed in a cartridge which is removably mountable in the main assembly of an image forming apparatus. Also according to this process cartridge system, an image forming apparatus can be maintained by users themselves without relying on service personnel, and therefore, operational efficiency can be drastically improved. As a result, a process cartridge system is widely used in the field of the image forming apparatus.

In the case of an electrophotographic image forming apparatus employing such a process cartridge system as described above, users themselves replace a process cartridge. Thus, some image forming apparatuses or process cartridges are provided with a means for informing the users of the remaining amount of developer as developer is consumed.

As for a conventional apparatus for detecting the remaining amount of developer, a set of two electrically conductive rods are placed in a developer container, and the change in the electrostatic capacity between the two rods is detected to estimate the amount of the developer in the container.

Japanese Laid-Open Patent Application 5-100571 discloses a developer amount detecting apparatus which employs a developer amount detecting member comprising a more sophisticated pair of electrodes than the aforementioned pair of electrically conductive rods. More specifically, it comprises a pair of thin flat electrodes which look like the head portion of a rake with parallel tines, and are placed adjacent to each other in such a manner that the parallel tines of one electrode fit in the intervals of the parallel tines of the other electrode, one for one, forming a labyrinth between the two electrodes. This developer amount detecting member is placed on the bottom surface of the developer chamber of the developer container. In the case of this developer amount detecting apparatus, the change in the amount of the electrostatic capacity between the two electrodes, the parallel tines of one of which are placed in parallel to the parallel tines of the other in the same plane, is detected to determine the remaining amount of the developer.

However, in both of the above described developer amount detecting apparatuses, what is detected is whether or not developer is present in the developer container; in other words, what the above developer amount detecting apparatuses can detect is that the amount of the developer in the developer container is small immediately before the developer container runs out of the developer. Therefore, they cannot determine the amount of the developer remaining in the developer container.

In comparison, if it is possible to substantially continuously (or substantially real time) detect the amount of the developer remaining in the developer container, a user can estimate when the current process cartridge needs to be replaced, based on the remaining amount of the developer in the developer container, and can prepare a fresh process cartridge accordingly. This is very convenient for the user.

SUMMARY OF THE INVENTION

The primary object of the present invention is to provide a process cartridge, and an electrophotographic image forming apparatus, the remaining amount of the developer in which can be substantially continuously (or substantially real time) detected.

Another object of the present invention is to provide a process cartridge and an electrophotographic image forming apparatus, the remaining amount of the developer in which can be continuously detected on the basis of the change in electrostatic capacity.

Another object of the present invention is to provide a process cartridge and an electrophotographic image forming apparatus, the remaining amount of the developer in which can be continuously detected more accurately, compared to a conventional process cartridge and a conventional electrophotographic image forming apparatus.

Another object of the present invention is to provide a process cartridge and an electrophotographic image forming apparatus, in which the developer does not adhere to the surface of the developer amount detecting member, and/or the surface of the cartridge frame, and the remaining amount of the developer in which can be continuously detected.

Another object of the present invention is to provide a process cartridge and an electrophotographic image forming apparatus, the remaining amount of the developer in which can be continuously detected with the use of a developer amount detecting member placed on the external surface of the cartridge frame.

Another object of the present invention is to provide a process cartridge and an electrophotographic image forming apparatus, which comprise a developer amount detecting member placed on the external surface of the cartridge frame, and in which the portion of the internal surface of the process cartridge frame, the position of which corresponds to the position of the developer amount detecting member on the external surface of the cartridge frame, can be wiped by a developer conveying member.

Another object of the present invention is to provide a process cartridge and an electrophotographic image forming apparatus, which comprise a developer amount detecting member for generating electrical signals used by the main apparatus of the image forming apparatus to continuously detect the remaining amount of the developer, and in which the developer amount detecting member is attached to the cartridge frame, across the portion which is given a cylindrical curvature, and is wiped by the developer conveying member as the developer conveying member is rotated, in a manner to conform to the surface of the portion to which it is attached, along the passage of the developer from the developer container to the developing member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the process cartridges and electrophotographic image forming apparatuses in accordance with the present invention will be described in detail with reference to the appended drawings.

Embodiment 1

First, referring to FIGS. 1–3, the first embodiment of the present invention will be described.

Figure 1:
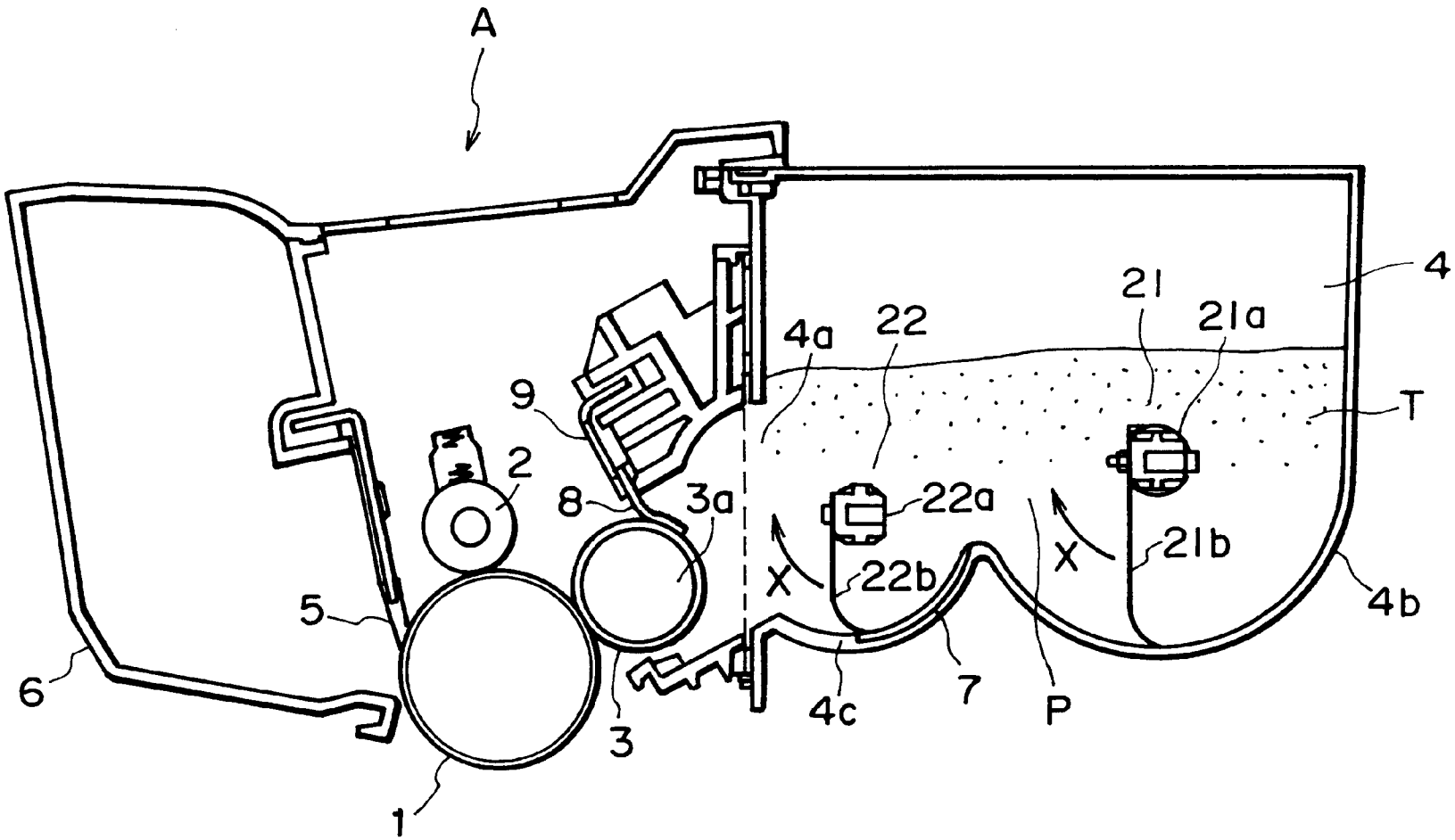
FIG. 1 is a drawing for showing the general structure of the process cartridge in the first embodiment of the present invention.

Referring to FIG. 1, the process cartridge A in this embodiment integrally comprises: a photosensitive drum 1 as an electrophotographic photosensitive member; a charging means 2 for uniformly charging the peripheral surface of the photosensitive drum 1; a developing apparatus which comprises a development roller 3 as a developer bearing member placed in a manner to squarely oppose the photosensitive drum 1, and a developer containing portion 4*b* (developer storing portion; cartridge frame) which is located next to the development roller 3, and is formed of resinous material such as polystyrene; and a cleaning means holding portion 6 which contains a cleaning member 5. The developer holding portion 4*b* and cleaning means holding portion 6 are joined together to make up the frame of the process cartridge. The cartridge frame is formed of resinous material such as high impart styrene.

Figure 2:
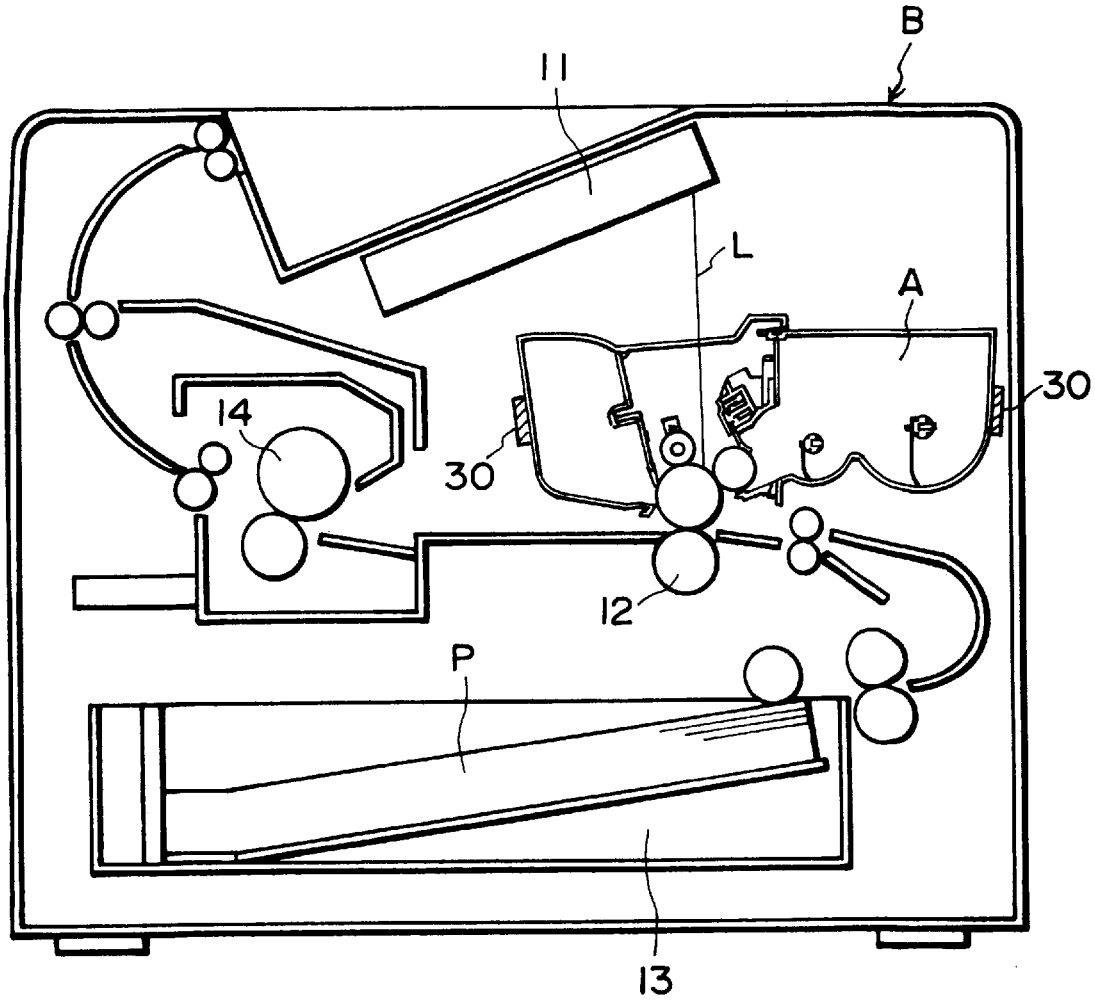
FIG. 2 is a drawing for showing the general structure of the electrophotographic image forming apparatus in the first embodiment of the present invention.

Next, referring to FIG. 2, a laser beam printer B, which is an example of an electro-photographic image forming apparatus comprises: a process cartridge A mounted in the main assembly of the printer, with the interposition of a process cartridge mounting means 30; a laser scanner 11 as an electrostatic latent image forming means, which is placed above the process cartridge mounting space to project a laser beam L in accordance with image information; and a transferring means placed below the process cartridge mounting space in a manner to squarely oppose the photosensitive drum 1.

In the electrophotographic image forming apparatus structured as described above, an image is formed in the following manner. First, the photosensitive drum 1 is uniformly charged by the charging means 2, and the uniformly charged peripheral surface of the photosensitive drum 1 is exposed to the laser beam L projected in a scanning manner. As a result, an electrostatic latent image in accordance with image information is formed. This electrostatic latent image is developed into a visual image (developer image) by the development roller 3; the developer within the developer holding portion 4*b* is adhered to the peripheral surface of the photosensitive drum 1 by the development roller 3 in a manner to reflect the electrostatic latent image. The developer employed in this embodiment is electrically nonconductive, single component developer.

The developer image on the photosensitive drum 1 is transferred by the transferring means 12, onto a sheet P of recording medium which has been fed out of a sheet cassette 13 and has been conveyed to the transferring means 12. Then, the recording medium sheet P is conveyed to a fixing means 14, in which the developer image is fixed to the recording medium sheet P. Thereafter, the recording medium sheet P is discharged out of the apparatus main assembly.

During the image forming operation, the developer T within the developer holding portion 4*b* must be supplied to the development roller 3 through the opening 4*a* of the developer holding portion 4*b* (portion outlined by a dotted line in FIG. 1). When the process cartridge A is brand-new, the opening 4*a* is sealed with an unillustrated sealing member. Therefore, a user must mount the process cartridge A into the apparatus main assembly after exposing the opening 4*a* by removing the sealing member.

Again referring to FIG. 1, in this embodiment, the developer holding portion 4*b* is wide, and therefore, two developer forwarding means 21 and 22 as developer conveying means are provided for supplying the developer within the developer holding portion 4*b*, to the development roller 3. The developer forwarding means 21 and 22 comprise rotational shafts 21*a* and 22*a*, and sheets 21*b* and 22*b*, respectively, which are formed of resinous material such as polyether resin or polyphenyl-sulfide resin. The sheets 21*b* and 22*b* are flexible. Their free edges come into contact with the internal surface of the developer holding portion 4*b* as the amount of the developer T within the developer holding portion 4*b* falls below a certain level, although they may curve in the direction opposite to the rotational direction of the rotational shafts 21*a* and 22*a*, failing to contact the internal surface of the developer holding portion 4*b* when the process cartridge A is full of developer, or when the amount of the developer T in the developer holding portion 4*b* is substantial. Further, the developer holding portion 4*b* is shaped so that its bottom wall conforms to the shapes of the sweeping areas of the developer forwarding means 21 and 22. With this arrangement, even when the amount of the developer T remaining in the developer holding portion 4*b* becomes very small, the developer T in the developer holding portion 4*b* can be sent to the developer roller 3 by the toner forwarding means 21 and 22 without being left at the bottom of the developer holding portion 4*b*.

The development roller 3 is a nonmagnetic, metallic cylinder, and is rotationally placed in parallel to the photosensitive drum 1, with the provision of a predetermined distance between the peripheral surfaces of the photosensitive drum 1 and development roller 3. Within the development roller 3, a magnet 3*a* is stationarily fixed. The peripheral surface of the development roller 3 is in contact with a regulating blade 8, as a developer regulating member, which is formed of urethane rubber and is fixed to a metallic supporting member 9.

After being sent to the development roller 3 from the developer holding portion 4*b*, the developer T is adhered to the peripheral surface of the development roller 3 by being attracted by the magnetic force from the magnet 3*a* within the development roller 3. Then, as the development roller 3 is rotated, the developer T on the peripheral surface of the development roller 3 is carried to the adjacencies of the photosensitive drum 1. The amount of the developer T adhering to the development roller 3 is regulated by the blade 8 to a predetermined amount. A certain portion of the developer T adhering to the peripheral surface of the development roller 3 transfers onto the photosensitive drum 1 in response to the difference in potential level between the electrostatic latent image on the photosensitive drum 1, and the development roller 3, in the area in which the distance between the peripheral surfaces of the photosensitive drum 1 and development roller 3 is smallest, whereas the rest of the developer T adhering to the peripheral surface of the development roller 3 remains on the peripheral surface of the development roller 3. During this process of developing the latent image on the photosensitive drum 1, an AC bias with predetermined frequency and amplitude, and a variable DC bias are applied to the development roller 3.

Figure 3:
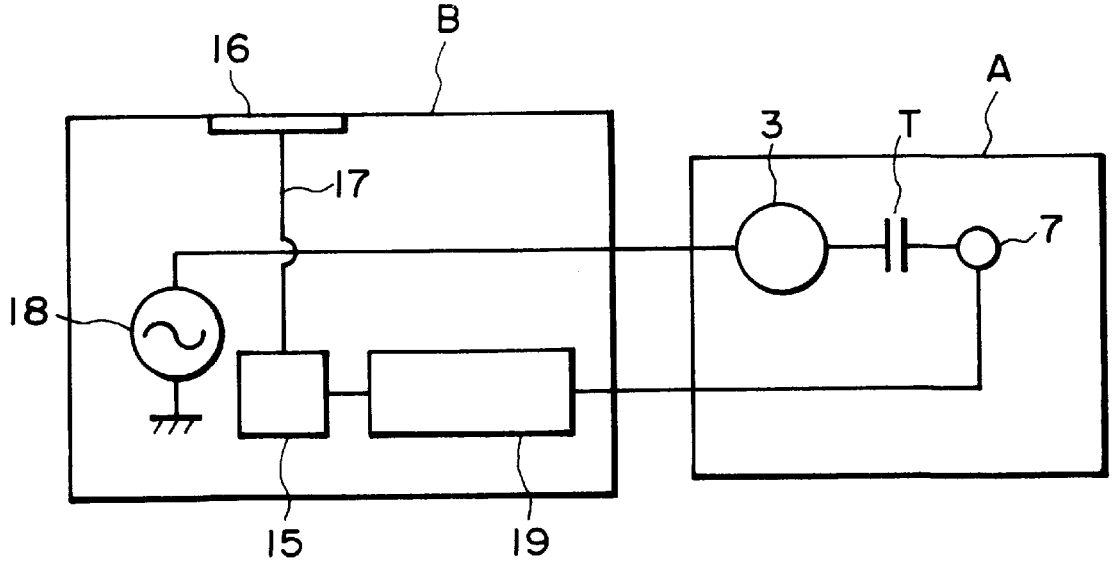
FIG. 3 is a diagram of an example of a toner amount measuring circuit in accordance with the present invention.

FIG. 3 schematically shows a method for measuring the amount of the developer with the use of a developer amount detecting member 7, that is, the remaining developer amount detecting means in this embodiment.

The AC bias is applied to the development roller 3 from a power source 18 provided on the apparatus main assembly side. As a result, electrical current, the value of which corresponds to the electrostatic capacity between the development roller 3 and developer amount detecting member 7, flows between the two. This electrostatic capacity changes in response to the change in the amount of the developer T. Thus, the amount of the developer T between the development roller 3 and developer amount detecting member 7 can be continuously known by measuring the value of the electrical current which flows from the developer amount detecting member 7, with the use of a current detecting means 19. Incidentally, the developer amount detecting member 7 is formed of metallic material, for example, iron, aluminum, phosphor bronze, and the like. It is approximately the same in length as the development roller 3, and extends in the longitudinal direction of the development roller 3.

The power source 18 for the bias to be applied to the development roller 3, the current measuring means 19 for measuring the current which flows to the developer amount detecting member 7, a converting means 15 for converting the detected current value into the developer amount, a displaying means for displaying the developer amount, a transmitting means 17 for transmitting the developer amount to the displaying means 16, and the like, are placed in the apparatus main assembly B. The printer main assembly B and process cartridge A are electrically connected to each other through the corresponding electrical contacts.

In this embodiment, the developer amount detecting member 7, that is, a piece of metallic plate or foil, is attached to the internal surface of the bottom wall of the developer holding portion 4*b* (cartridge frame), across the portion below the developer forwarding means 22, that is, the developer forwarding means closer to the development roller 3 of the two developer forwarding means 21 and 22. Further, the developer forwarding means 22 is placed between the development roller 3 and developer amount detecting member 7. This positioning of the developer detecting member 7 does not make it possible to measure the change in the developer amount within the sweeping range of the developer forwarding means 21. However, in a condition in which the developer is present in the sweeping range of the developer forwarding means 21, there is a substantial amount of the developer in the developer holding portion 4*b*; in other words, this is not a condition in which a user needs to be concerned about the developer shortage. In other words, only thing that is important here is that the developer amount can be continuously and accurately measured after the developer within the developer holding portion 4*b* is consumed to a point at which there is virtually no developer within the sweeping range of the developer forwarding means 21, that is, after the amount of the developer within a process cartridge falls into a range of ½–1/10 of the total amount of the developer within a process cartridge which has never been used (amount of the developer within the process cartridge when the process cartridge is full). Incidentally, the sheets 21*b* and 22*b* of the developer forwarding means 21 and 22, respectively, rotate in the direction indicated by the arrow marks in the drawing.

Placing the developer amount detecting member 7 below the developer forwarding means 21, or the developer forwarding means which is farther from the development roller 3 of the two developer forwarding means, makes the distance between the developer amount detecting member 7 and development roller 3 smaller, and therefore, the electrostatic capacity becomes smaller. In addition, such a placement of the developer amount detecting member 7 increases the amount of the developer between the development roller 3 and developer amount detecting member 7, reducing the amount of the change in the electrostatic capacity relative to the amount of the developer. Therefore, it becomes difficult to accurately measure the developer amount.

Moreover, placing the developer forwarding means 22, which operates in a manner to wipe the bottom of the developer holding portion 4*b*, between the development roller 3 and developer amount detecting member 7 makes it possible to accurately predict when image formation will become impossible, from the rate of the decrease in the developer amount.

For example, it is assumed here that if the amount of the developer on the development roller 3 falls below 20 g, it becomes impossible to form a satisfactory image. With the presence of the developer forwarding means 22, which operates as described above, by the time the amount of the developer on the development roller 3 reduces to 20 g, there will be no developer, except for the developer on the development roller 3. Therefore, if the measured amount of the developer on the development roller 3 is 30 g, it is evident that the on-going image forming operation can be continued for a duration equivalent to 10 g of the developer, or the difference between 30 g and 20 g. On the contrary, without the presence of the developer forwarding means which operates in a manner to wipe the bottom of the developer holding portion 4*b*, it is possible that there may remain a certain amount of developer in the adjacencies of the developer amount detecting member 7. In such a case, even if it is detected by the developer amount detecting member 7 that 25 g of developer still remains in the developer holding portion 4*b*, there may be only 20 g of developer in the adjacencies of the development roller 3, and therefore, it may be impossible to produced a satisfactory image. In other words, without the presence of a developer forwarding means such as the developer forwarding means 22, which operates in a manner to wipe the bottom wall of the developer holding portion 4*b*, in the developer holding portion 4*b*, the amount of the developer which remains in the bottom portion of the developer holding portion 4*b* varies depending upon the operating environment, and therefore, a developer amount, below which a satisfactory image cannot be formed, is not definite. In other words, even if it is detected that the amount of the remaining developer is 25 g, it is still impossible to predict how long the current image forming operation can be continued.

In comparison, in the case of the structure in this embodiment, when it is detected that the amount of the remaining developer is 25 g, it may be predicted, with a high level of accuracy, that satisfactory images can be formed for a duration equivalent to 5 g of developer.

Further, in this embodiment, the developer forwarding means 22 is formed of only resinous material; in other words, no metallic material is used. This is due to the fact that if a substance, besides the developer, the amount of which affects the electrostatic capacity, is between the development roller 3 and developer amount detecting member 7, the developer amount cannot be accurately detected.

In this embodiment, the number of developer forwarding means is two. Obviously, the present invention is also effectively applicable to an image forming apparatus with three or more developer forwarding means.

As described above, in this embodiment, the electrostatic capacity between the development roller 3 and developer amount detecting member 7 is measured immediately after the mounting of a process cartridge into the main assembly of an image forming apparatus. With the provision of this arrangement, the developer amount in a process cartridge can begin to be continuously and accurately detected, without derogatorily affecting image formation, a substantial length of time prior to when satisfactory image formation becomes impossible, and therefore, it is possible to accurately predict the length of time (or number of copies) it takes for the amount of the remaining toner reduce to a point at which satisfactory image formation becomes impossible. In addition, this arrangement does not require increase in the process cartridge size.

Embodiment 2

Next, referring to FIG. 4, the second embodiment of the present invention will be described.

Figure 4:
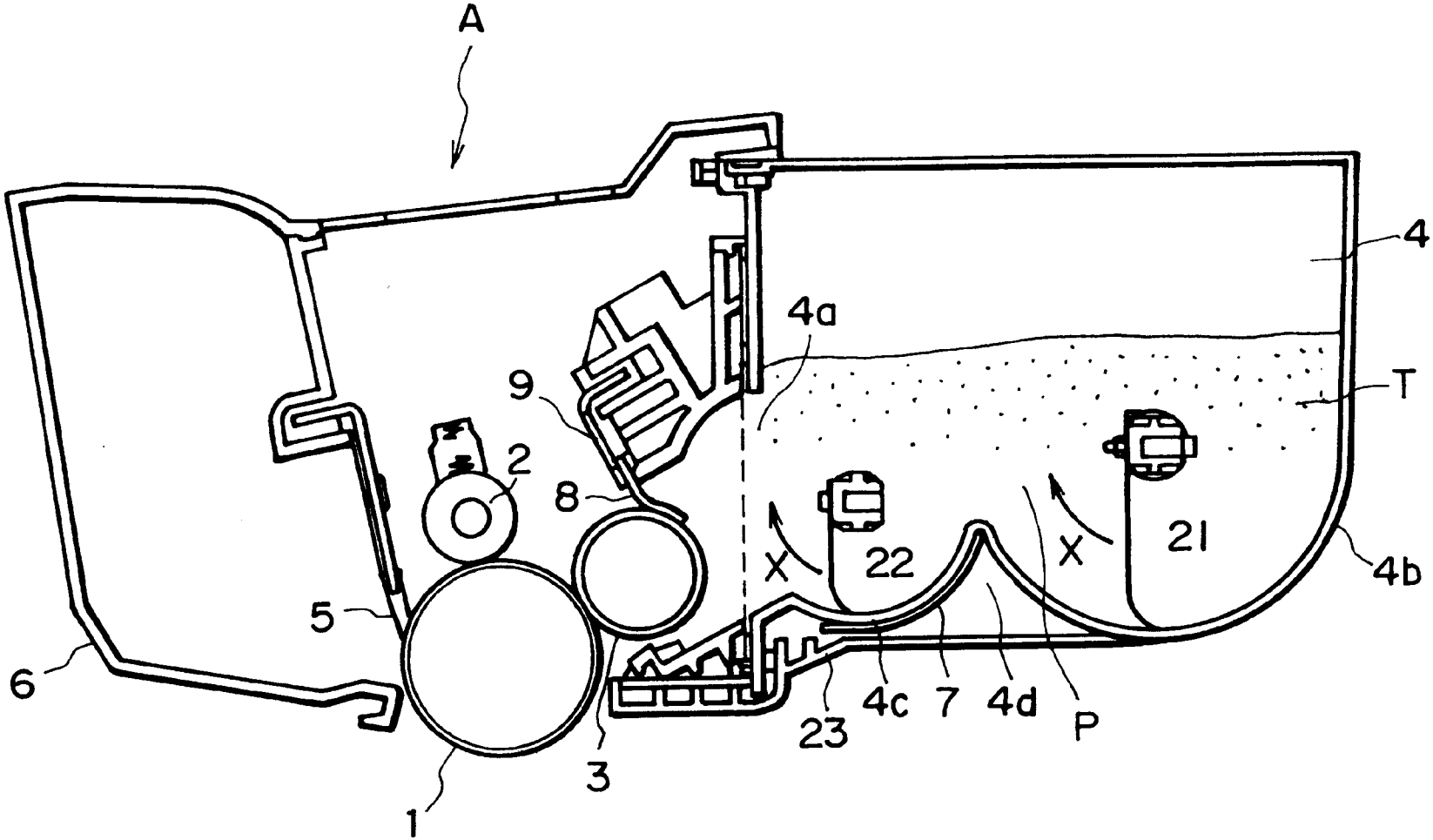
FIG. 4 is a drawing for showing the general structure of the process cartridge in the second embodiment of the present invention.

In this embodiment, the developer amount detecting member 7 is placed outside the developer holding portion 4*b*, and in addition, the area of the exterior of the developer holding portion 4*b*, to which the developer amount detecting member 7 is attached, is covered with a cover 23 as shown in FIG. 4. The developer holding portion 4*b* is formed of resin, and therefore, only thing that makes the electrostatic capacity between the development roller 3 and developer amount detecting member 7 in this embodiment different from that in the first embodiment is the increased distance between the development roller 3 and developer amount detecting member 7, which is greater by the thickness of the developer holding portion 4*b* than that in the first embodiment. Therefore, whether the developer amount detecting member 7 is within or outside the developer holding portion 4*b*, the developer amount in the developer holding portion 4*b* can be measured with the same continuity and accuracy as that in the first embodiment.

Further, the placement of the developer amount detecting member 7 outside the developer holding portion 4*b* in this embodiment makes it possible to place the entire wiring for transmitting electrical signals from the developer amount detecting member 7 to the contact of the printer main assembly B, on the exterior surface of the developer holding portion 4*b*.

Referring to FIG. 3, the signals outputted from the developer amount detecting member 7 are sent to the printer main assembly B through the contacts. For this reason, the wiring must be placed from the developer amount detecting member 7 to the contact on the exterior of the process cartridge A. If the developer amount detecting member 7 is within the developer holding portion 4*b* as in the first embodiment, the wiring from the developer amount detecting member 7 to the contact on the exterior of the process cartridge A must be put through the hole in the wall of the developer holding portion 4*b*.

On the contrary, the placement of the developer amount detecting member 7 outside the developer holding portion 4*b* as in this embodiment makes it unnecessary to make a hole through the wall of the developer holding portion 4*b*.

Also in this embodiment, the cover 23 formed of resin is placed to cover the adjacencies of the exterior of the developer holding portion 4*b* and a part of the developing means frame portion, from the area corresponding to the position of the developer amount detecting member 7 to the area corresponding to the position of the development roller 3, as shown in FIG. 4.

With the provision of this cover 23, which is placed in a manner to cover the adjacencies of the exterior of the developer holding portion 4*b* and a part of the developing means frame portion, from the area correspondent to the position of the development roller 3 to the area corresponding to the position of the developer amount detecting member 7, it is possible to prevent the problem that the accuracy with which the developer amount is measured is reduced by the adhesion of the foreign substances such as dust to the developer amount detecting member 7.

As described above, the placement of the developer amount detecting member 7 outside the developer holding portion 4*b* as in this embodiment simplifies the process cartridge structure. Further, the provision of the cover as in this embodiment makes it possible to prevent the reduction in the developer amount measurement accuracy, without increasing the process cartridge size and/or the provision of an apparatus for removing the foreign substances which adhere to the developer amount detecting member 7.

Embodiment 3

Next, referring to FIGS. 5 and 6, the third embodiment of the present invention will be described.

In this embodiment, the developer amount detecting apparatus is structured so that the development roller 3 and a metallic supporting member 9 for supporting the toner regulating member 8 are made the same in potential level by an appropriate means, and the developer amount is determined from a combination of the measured electrostatic capacities between the development roller 3 and developer amount detecting member 7, and between the metallic supporting member 9 and developer amount detecting member 7. This structure is characterized by the positional relationships among the development roller 3, developer amount detecting member 7, and metallic supporting member 9.

Figure 5:
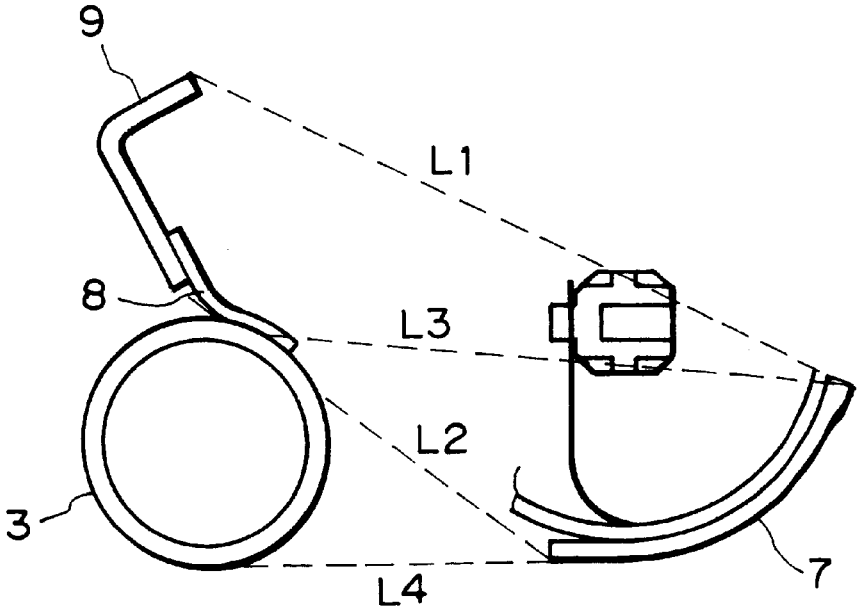
FIG. 5 is a drawing for depicting the essential portion of the process cartridge in the third embodiment of the present invention.

More specifically, referring to FIG. 5, the region in which the change in the electrostatic capacity between the developer amount detecting member 7 and development roller 3 can be measured is the region sandwiched between a line L3 connecting the top end of the developer amount detecting member 7 and the highest point on the development roller 3, a line L4 connecting the bottom end of the developer amount detecting member 7 and the lowest point on the development roller 3, whereas the region in which the change in the electrostatic capacity between the developer amount detecting member 7 and metallic supporting member 9 can be measured is the region sandwiched between a line L1 connecting the top end of the developer amount detecting member 7 and the top end of the metallic supporting member 9, and a line L2 connecting the bottom end of the developer amount detecting member 7 and the bottom end of the metallic supporting member 9.

Therefore, in this embodiment, it is assured that the change in the electrostatic capacity within the region surrounded by the line L1, metallic supporting member 9, toner regulating member 8, development roller 3, line L4, and developer amount detecting member 7 is accurately known; in other words, the developer amount in the region sandwiched between the lines L1 and L4, can be accurately known.

Figure 6:
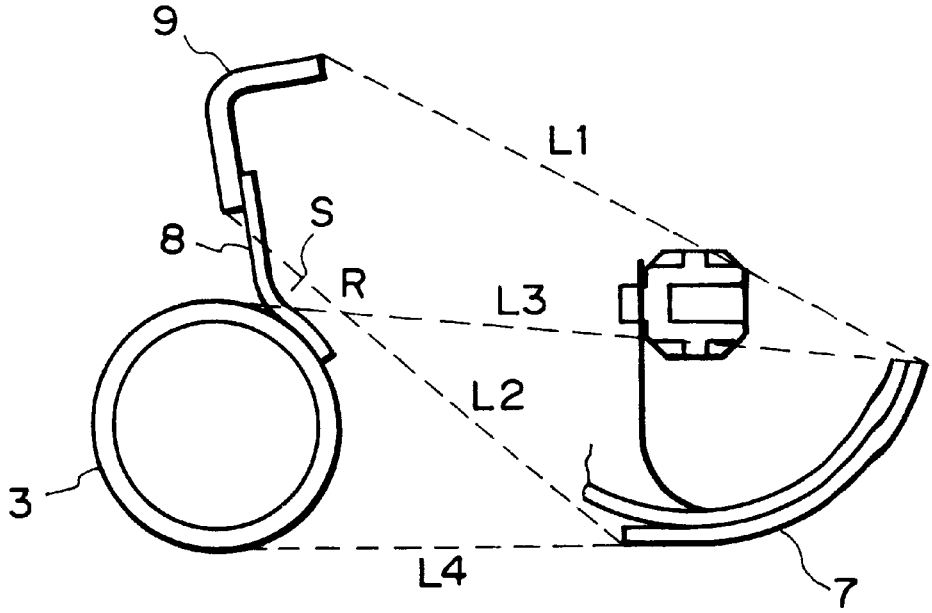
FIG. 6 is a drawing of a process cartridge comparable to the process cartridge illustrated in FIG. 5.

On the other hand, in the comparative example illustrated in FIG. 6, the intersection R between lines L2 and L3 drawn in the same manner in FIG. 6 as the lines L2 and L3 in FIG. 5 is in the region surrounded by the line L1, metallic supporting member 9, toner regulating member 8, development roller 3, line L4, and developer amount detecting member 7. This means that it is difficult to accurately judge the amount of the developer in a space S, that is, a space sandwiched between the far sides, with respect to the intersection R, of the two sections of the lines L2 and L3 divided by the intersection R, as seen from the position of the developer amount detecting member 7. Thus, if there is a possibility that a certain amount of the developer might be in the space S, the developer amount measurement accuracy reduces by the amount equivalent to the amount of the developer which possibly remains in the space S.

In the case of this comparative example, the space S can be eliminated by extending the developer amount detecting member 7 by an appropriate length from its left end toward the development roller 3 following the line L4. With this arrangement, the developer amount within the region sandwiched between the lines L1 and L4 can be accurately measured.

As described above, in this embodiment, the developer amount detecting member 7 is placed so that no gap is created between the development roller 3 and metallic supporting member 9, as seen from the position of the developer amount detecting member 7. With this arrangement, no region in which accurate measurement of the development amount is impossible is created, and therefore, the developer amount can be accurately measured. Further, since the development roller 3 and metallic supporting member 9 are equal in potential level, the electrostatic capacity between the developer amount detecting member 7 and the combination of the development roller 3 and metallic supporting member 9 is greater than the electrostatic capacity measured in the preceding embodiments, increasing thereby the developer amount detection accuracy.

Figure 7:
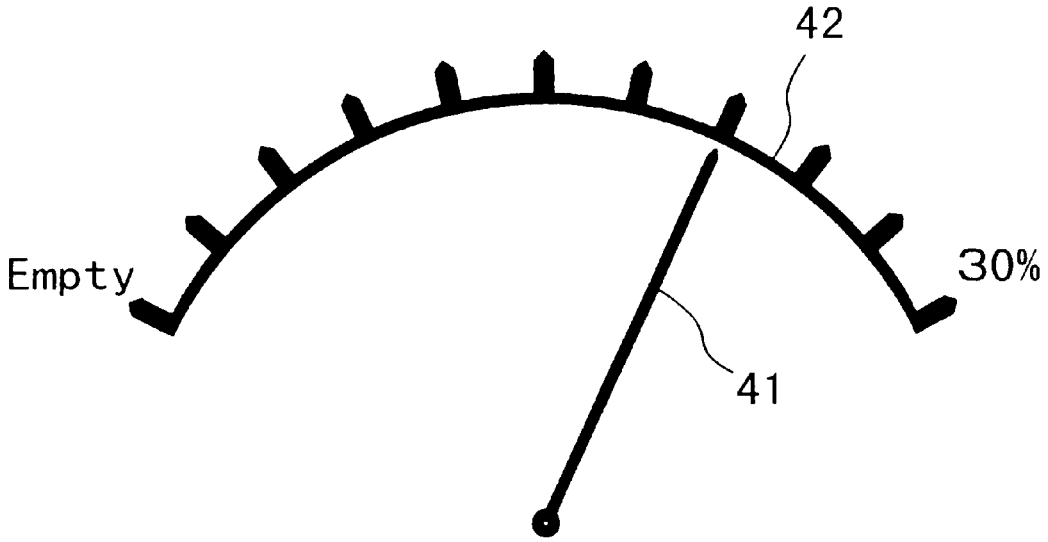
FIG. 7 is a drawing for depicting a method for displaying the developer amount.

Next, a method for displaying the developer amount will be described. For example, the information detected by the above described developer amount detecting member 7 may be displayed on the monitor of the personal computer of the user of the image forming apparatus as shown in FIG. 7. In other words, the developer amount is reported to the user as a point on a gauge 42 indicated by a hand 41, the movement of which is proportional to the developer amount.

Figure 8:
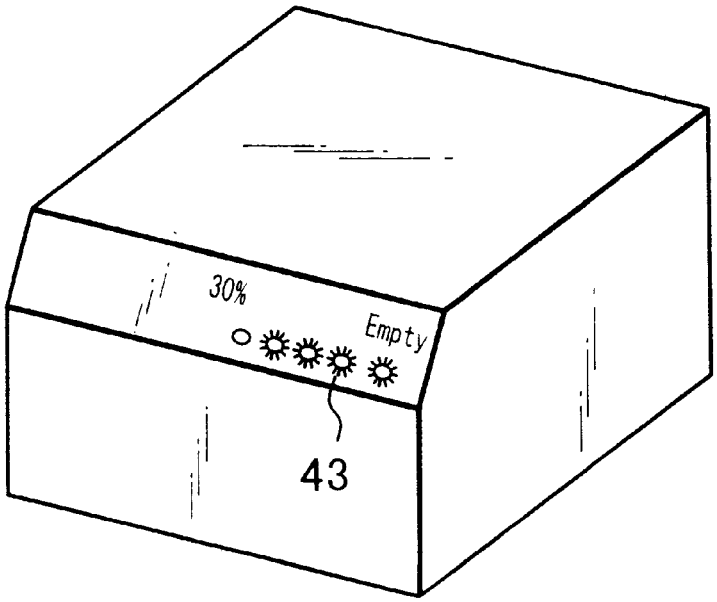
FIG. 8 is a drawing for depicting another method for displaying the developer amount.

Further, referring to FIG. 8, a display comprising a plurality of LEDs or the like may be directly placed on the main assembly of an electrophotographic image forming apparatus, so that the developer amount can be indicated by turning on or off a particular LED, among the plurality of the LEDs 43, which corresponds to the detected developer amount.

The present invention does not limit the selection of the developer amount detection range to only a full range, that is, from the point at which the developer amount is 100% (developer holding portion 4*b* is full) to the point at which the developer amount is 0% (developer holding portion is empty). For example, the range in which the developer amount is detected may be such a range in which the developer amount is from 30% down to 0% of the full amount. It should be noted here that 0% does not mean that the developer has been completely consumed; it also includes such a condition that the amount of the developer in the developer holding portion 4*b* has decreased to a level below which it is impossible to produce an image with a predetermined level of quality.

The embodiments are summarized as follows:

1. A process cartridge A detachably mountable to a main assembly B of an electrophotographic image forming apparatus, comprising:
   a cartridge frame (developer container 4*b*);
   an electrophotographic photosensitive member
   a developer accommodating portion (developer container 4*b*) for accommodating a developer;
   a developing member (developing roller 3) for developing an electrostatic latent image formed on said electrophotographic photosensitive member 1 with the developer;
   a developer feeding member 21, 22 for feeding the developer accommodated in said developer accommodating portion (developer container 4*b*) toward said developing member (developing roller 3); and
   a developer amount detecting member 7, disposed along a movement path P of the developer from said developer accommodating portion (developer container 4*b*) toward said developing member (developing roller 3), for generating an electric signal for permitting the main assembly B to detect substantially real time a remaining amount of the developer in the process cartridge A, wherein said developer amount detecting member 7 is disposed at and along an arcuate portion 4*c* which is provided outside said cartridge frame (developer container 4*b*) along a path P of rotational motion of said developer feeding member 22.
2. A process cartridge A according to Item 1, wherein said developer amount detecting member 7 generates the electric signal corresponding to an electrostatic capacity between said developing member (developing roller 3) in the form of a developing roller 3 and itself when a developing bias is applied to said developing roller 3 from the main assembly B of apparatus.
3. A process cartridge A according to Item 2, wherein said developer feeding member 22 comprises non-metal material, and said developer amount detecting member 7 comprises metal material.

4. A process cartridge A according to Item 1, 2 or 3, wherein said developer amount detecting member 7 is provided on an inner surface of said arcuate portion 4*c*, and said developer feeding member 22 starts to slide on a surface of said developer amount detecting member 7 when the remaining amount of the developer in said process cartridge A reduces. (FIG. 1) Because of this feature, depositon of the developer T on the surface of the detecting member 77.

5. A process cartridge A according to Item 1, 2 or 3, wherein said developer amount detecting member 7 is provided on an outer surface of said arcuate portion 4*c*, and said developer feeding member 22 starts to slide on an inner surface of the arcuate portion 4*c* when the remaining amount of the developer in said process cartridge A reduces. (FIG. 4). Because of this feature, deposition of the developer T on the inner surface of the detecting member 7.

6. A process cartridge according to Item 5, wherein said developer amount detecting member 7 provided on the outer surface of the arcuate portion 4*c* is covered with a non-metal cover 23 disposed on an outer surface outside said cartridge frame so as to bridge over a recess 4*d* of said cartridge frame.

As described in the foregoing, according to the present invention, the remaining amount of the developer can be detected substantially real time.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus, comprising:

a cartridge frame;

an electrophotographic photosensitive member;

a developer accommodating portion for accommodating a developer;

a developing member for developing an electrostatic latent image formed on said electrophotographic photosensitive member with the developer;

a developer feeding member for feeding, by rotation thereof, the developer accommodated in said developer accommodating portion toward said developing member; and a developer amount detecting member, disposed along a movement path of the developer from said developer accommodating portion toward said developing member, for generating an electric signal for permitting the main assembly to detect in substantially real time a remaining amount of the developer in the process cartridge, wherein said developer amount detecting member is disposed at and along an arcuate portion of said cartridge frame formed along a path of rotational motion of said developer feeding member, wherein said developer amount detecting member generates the electric signal corresponding to an electrostatic capacity between said developing member and itself when a developing bias is applied to said developing member from the main assembly of the apparatus.

2. A process cartridge according to claim 1, wherein said developer feeding member comprises non-metal material, and said developer amount detecting member comprises metal material.

3. A process cartridge according to claim 1 or 2, wherein said developer amount detecting member is provided on an inner surface of said arcuate portion, and an end portion of said developer feeding member starts to slide on a surface of said developer amount detecting member when the remaining amount of the developer in said process cartridge is reduced.

4. A process cartridge according to claim 1 or 2, wherein said developer amount detecting member is provided on an outer surface of said arcuate portion, and an end portion of said developer feeding member starts to slide on an inner surface of the arcuate portion when the remaining amount of the developer in said process cartridge is reduced.

5. A process cartridge according to claim 4, wherein said developer amount detecting member provided on the outer surface of the arcuate portion is covered with a non-metal cover disposed on an outer surface outside said cartridge frame so as to bridge over a recess of said cartridge frame.

6. A process cartridge detachably mountable to a main assembly of an electrophotographic image forming apparatus, comprising:

a cartridge frame;

an electrophotographic photosensitive drum;

a developer accommodating portion for accommodating a developer;

a developing roller for developing an electrostatic latent image formed on said electrophotographic photosensitive drum with the developer;

a non-metal developer feeding member for feeding, by rotation thereof the developer accommodated in said developer accommodating portion toward said developing roller;

a developer amount detecting member of metal material, disposed along a movement path of the developer from said developer accommodating portion toward said developing roller, for generating an electric signal for permitting the main assembly to detect in substantially real time a remaining amount of the developer in the process cartridge, wherein said developer amount detecting member is disposed at and along an arcuate portion of said cartridge frame formed along a path of rotational motion of said developer feeding member, and wherein said developer amount detecting member is provided on an outer surface of said arcuate portion, and an end portion of said developer feeding member starts to slide on an inner surface of said arcuate portion when the remaining amount of the developer in said process cartridge is reduced, and wherein said developer amount detecting member generates the electric signal corresponding to an electrostatic capacity between said developing roller and itself when a developing bias is applied to said developing roller from the main assembly of apparatus.

7. A process cartridge according to claim 6, wherein said developer amount detecting member provided on the outer surface of the arcuate portion is covered with a non-metal cover disposed on an outer surface outside said cartridge frame so as to-bridge over a recess of said cartridge frame.

8. A process cartridge according to claim 1 or 6, wherein said developer feeding member includes a shaft and a sheet which are made of resin material.

9. An electrophotographic image forming apparatus for forming an image on a recording material, wherein a process cartridge is detachably mountable to said image forming apparatus, said apparatus comprising:

(i) a mounting means for detachably mounting a process cartridge, said process cartridge including:
a cartridge frame;
an electrophotographic photosensitive member;
a developer accommodating portion for accommodating a developer;
a developing member for developing an electrostatic latent image formed on said electrophotographic photosensitive member with the developer;
a developer feeding member for feeding the developer accommodated in said developer accommodating portion toward said developing member; and
a developer amount detecting member, disposed along a movement path of the developer from said developer accommodating portion toward said developing member, for generating an electric signal for permitting the main assembly to detect in substantially real time a remaining amount of the developer in the process cartridge, wherein said developer amount detecting member is disposed at and along an arcuate portion which is provided outside said cartridge frame along a path of rotational motion of said developer feeding member; and (ii) detecting means for detecting the remaining amount of the developer in said process cartridge in accordance with the electric signal from said developer amount detecting member.

10. An electrophotographic image forming apparatus for forming an image on a recording material, wherein a process cartridge is detachably mountable to said image forming apparatus, said apparatus comprising:

(i) a mounting means for detachably mounting a process cartridge, said process cartridge including:
a cartridge frame:
an electrophotographic photosensitive drum;
a developer accommodating portion for accommodating a developer;
a developing roller for developing an electrostatic latent image formed on said electrophotographic photosensitive drum with the developer;
a non-metal developer feeding member for feeding, by rotation thereof, the developer accommodated in said developer accommodating portion toward said developing roller;
a developer amount detecting member of metal material, disposed along a movement path of the developer from said developer accommodating portion toward said developing roller, for generating an electric signal for permitting the main assembly to detect in substantially real time a remaining amount of the developer in the process cartridge, wherein said developer amount detecting member is disposed at and along an arcuate portion of said cartridge frame formed along a path of rotational motion of said developer feeding member, and wherein said developer amount detecting member is provided with on an outer surface of said arcuate portion and, an end portion of said developer feeding member starts to slide on an inner surface of said arcuate portion when the remaining amount of the developer in said process cartridge is reduced, and wherein said developer amount detecting member generates the electric signal corresponding to an electrostatic capacity between said developing roller and itself when a developing bias is applied to said developing roller from the main assembly of apparatus; and (ii) detecting means for detecting the remaining amount of the developer in said process cartridge in accordance with the electric signal from said developer amount detecting member.

11. An apparatus according to claim 9 or 10, further comprising a display portion capable of displaying in substantially real time a remaining amount of the developer in said process cartridge, detected by said detecting means.

12. An apparatus according to claim 9 or 10, wherein the remaining amount of the developer in said process cartridge, detected by said detecting means is capable of being displayed in substantially real time on a display of a computer.

13. A process cartridge detachably mountable to a main assembly of an electrophotographic image forming apparatus, comprising:

a cartridge frame;
an electrophotographic photosensitive member;
a developer accommodating portion for accommodating a developer;
a developer member for developing an electrostatic latent image formed on said electrophotographic photosensitive member with the developer;
a developer feeding member for feeding, by rotation thereof, the developer accommodated in said developer accommodating portion toward said developing member; and
a developer amount detecting member, disposed along a movement path of the developer from said developer accommodating portion toward said developing member, for generating an electric signal for permitting the main assembly to detect in substantially real time a remaining amount of the developer in the process cartridge, wherein said developer amount detecting member is disposed at and along an arcuate portion of said cartridge frame formed along a path of rotational motion of said developer feeding member,
wherein said developer amount detecting member generates the electric signal corresponding to an electrostatic capacity between said developing member and itself when a developing bias is applied to said developing roller from the main assembly of apparatus,
wherein said developer amount detecting member is provided on an outer surface of said arcuate portion, and an end portion of said developer feeding member starts to slide on an inner surface of the arcuate portion when the remaining amount of the developer in said process cartridge is reduced,
wherein said developer feeding member includes a shaft and a sheet which are made of resin material.

14. A process cartridge according to claim 13, wherein said developer amount detecting member provided on the outer surface of the arcuate portion is covered with a non-metal cover disposed on an outer surface outside said cartridge frame so as to bridge over a recess of said cartridge frame.

15. A process cartridge detachably mountable to a main assembly of an electrophotographic image forming apparatus, comprising:

a cartridge frame;
an electrophotographic photosensitive member;
a developer accommodating portion for accommodating a developer;
a developer member for developing an electrostatic latent image formed on said electrophotographic photosensitive member with the developer;

a developer feeding member for feeding, by rotation thereof, the developer accommodated in said developer accommodating portion toward said developing member; and a developer amount detecting member, disposed along a movement path of the developer from said developer accommodating portion toward said developing member, for generating an electric signal for permitting the main assembly to detect in substantially real time a remaining amount of the developer in the process cartridge, wherein said developer amount detecting member is disposed at and along an arcuate portion of said cartridge frame formed along a path of rotational motion of said developer feeding member, wherein said developer amount detecting member generates the electric signal corresponding to an electrostatic capacity between said developing member and itself when a developing bias is applied to said developing roller from the main assembly of apparatus, wherein said developer amount detecting member is provided on an outer surface of said arcuate portion, and an end portion of said developer feeding member starts to slide on a surface of said developer amount detecting member when the remaining amount of the developer in said process cartridge is reduced, wherein said developer feeding member includes a shaft and a sheet which are made of resin material.

16. An electrophotographic image forming apparatus for forming an image on a recording material, wherein a process cartridge is detachably mountable to said image forming apparatus, said apparatus comprising:

(i) a mounting means for detachably mounting a process cartridge, said process cartridge including:

a cartridge;

an electrophotographic photosensitive member;

a developer accommodating portion for accommodating a developer;

a developing member for developing an electrostatic latent image formed on said electrophotographic photosensitive member with the developer;

a developer feeding member for feeding the developer accommodated in said developer accommodating portion toward said developing member; and a developer amount detecting member, disposed along a movement path of the developer from said developer accommodating portion toward said developing member, for generating an electric signal for permitting the main assembly to detect in substantially real time a remaining amount of the developer in the process cartridge, wherein said developer amount detecting member is disposed at and along an arcuate portion which is provided outside said cartridge frame along a path of rotational motion of said developer feeding member, wherein said developer amount detecting member is provided on an outer surface of said arcuate portion, and an end portion or said developer feeding member starts to slide on an inner surface of the arcuate portion when the remaining amount of the developer in said process cartridge is reduced, wherein said developer feeding member includes a shaft and a sheet which are made of resin material; and (ii) detecting means for detecting the remaining amount of the developer in said process cartridge in accordance with the electric signal from said developer amount detecting member.

17. An apparatus according to claim 16, further comprising a display portion capable of displaying in substantially real time a remaining amount of the developer in said process cartridge, detected by said detecting means.

18. An electrophotographic image forming apparatus for forming an image on a recording material, wherein a process cartridge is detachably mountable to said image forming apparatus, said apparatus comprising:

(i) a mounting means for detachably mounting a process cartridge, said process cartridge including:

a cartridge;

an electrophotographic photosensitive member;

a developer accommodating portion for accommodating a developer;

a developing member for developing an electrostatic latent image formed on said electrophotographic photosensitive member with the developer;

a developer feeding member for feeding the developer accommodated in said developer accommodating portion toward said developing member; and a developer amount detecting member, disposed along a movement path of the developer from said developer accommodating portion toward said developing member, for generating an electric signal for permitting the main assembly to detect in substantially real time a remaining amount of the developer in the process cartridge, wherein said developer amount detecting member is disposed at and along an arcuate portion which is provided outside said cartridge frame along a path of rotational motion of said developer feeding member, wherein said developer amount detecting member is provided on an inner surface of said arcuate portion, and an end portion or said developer feeding member starts to slide on a surface of said developer amount detecting member when the remaining amount of the developer in said process cartridge is reduced, wherein said developer feeding member includes a shaft and a sheet which are made of resin material; and (ii) detecting means for detecting the remaining amount of the developer in said process cartridge in accordance with the electric signal from said developer amount detecting member.

19. An apparatus according to claim 18, wherein the remaining amount of the developer in said process cartridge, detected by said detecting means is capable of being displayed in substantially real time on a display of a computer.

* * * * *

UNITED STATES PATENT AND TRADEMARK OFFICE

CERTIFICATE OF CORRECTION

PATENT NO. : 6,477,336 B2
DATED : November 5, 2002
INVENTOR(S) : Takashi Hibi

It is certified that error appears in the above-identified patent and that said Letters Patent is hereby corrected as shown below:

Title page,
Item [57], ABSTRACT,
Line 14, “detect” should read -- detect in --.

Column 1,
Line 19, “and” should read -- or --.

Column 2,
Lines 15 and 26, “(or” should read -- (or in --.

Column 6,
Line 17, “only” should read -- the only --.

Column 7,
Line 45, “reduce” should read -- to decrease --.
Line 60, “only” should read -- the only --.

Column 10,
Line 35, “member” should read -- member 1; --.
Line 51, “detect” should read -- detect in --.

Column 11,
Line 10, “depositon” should read -- deposition is averted --.
Line 11, “77” should read -- 7 --.
Line 20, “7.” should read -- 7 is averted. --
Line 29, “detected” should read -- detected in --.

Column 12,
Line 57, “of” should read -- of the --.

Column 13,
Line 59, “with” should be deleted.

Column 14,
Line 41, “of” should read -- of the --.

UNITED STATES PATENT AND TRADEMARK OFFICE

CERTIFICATE OF CORRECTION

PATENT NO. : 6,477,336 B2
DATED : November 5, 2002
INVENTOR(S) : Takashi Hibi

It is certified that error appears in the above-identified patent and that said Letters Patent is hereby corrected as shown below:

Column 15,
Line 19, “of” should read -- of the --.
Line 57, “or” should read -- of the --.

Column 16,
Line 43, “or” should read -- of --.

Signed and Sealed this

Twenty-ninth Day of July, 2003

JAMES E. ROGAN
*Director of the United States Patent and Trademark Office*